United States Patent [19]

Taylor

[11] Patent Number: 5,075,923

[45] Date of Patent: Dec. 31, 1991

[54] CONCEALED DOOR POSITIONING MECHANISM

[76] Inventor: Richard Taylor, 2135 W. Jefferson Blvd., Los Angeles, Calif. 90018

[21] Appl. No.: 637,834

[22] Filed: Jan. 7, 1991

[51] Int. Cl.[5] ..... E05C 17/02; E05C 17/34

[52] U.S. Cl. ..... 16/63; 16/49

[58] Field of Search ..... 16/49, 61-67, 16/69, 70, DIG. 9, DIG. 17, 78-80

[56] References Cited

U.S. PATENT DOCUMENTS

| | | | |
|---|---|---|---|
| 1,020,033 | 3/1912 | Flynn | 16/61 |
| 1,759,474 | 5/1930 | Volquardsen | 16/79 |
| 1,898,609 | 2/1933 | Anderson | 16/61 |
| 1,905,972 | 4/1933 | Foster | 16/63 |
| 1,962,291 | 6/1934 | Anderson | 16/63 |
| 4,048,695 | 9/1977 | Juilfs et al. | 16/80 |
| 4,297,812 | 11/1981 | McPhail | 16/78 |
| 4,639,969 | 2/1987 | Obenshain | 16/65 |

FOREIGN PATENT DOCUMENTS

| | | | |
|---|---|---|---|
| 138048 | 11/1952 | Sweden | 16/78 |

*Primary Examiner*—Robert L. Spruill
*Assistant Examiner*—Donald M. Gurley
*Attorney, Agent, or Firm*—Julius Rubinstein

[57] ABSTRACT

A door positioning device comprising a housing concealed in a door jamb and a mechanism mounted in the housing for holding the door open in one or more selected positions. The mechanism comprises a cylinder mounted in the housing wherein a slidable piston is mounted. Linkage connects the piston to linkage mounted onto the door, in such a way that when the door opens, the linkage forces the piston upward in the cylinder. A shaft integral with the piston depends from the piston and is moveable with it. The shaft has a plurality of vertically spaced roller receiving recesses formed thereon. The housing has a movably mounted roller biased toward the shaft so as the door opens, the shaft moves upward in the cylinder until the roller moves into one of the vertically spaced recesses whereby the door is held open at a selected position. In this way when a slight pressure is exerted on the door it overcomes bias holding the roller in a recess formed in the shaft, allowing the door to close.

7 Claims, 2 Drawing Sheets

CONCEALED DOOR POSITIONING MECHANISM

This invention relates to a concealed door positioning mechanism for doors with specialized shapes which can releasibly hold the door open in one or more positions.

BACKGROUND AND BRIEF SUMMARY OF INVENTION

Heretofore, as exemplified by the patent to Van Veen No. 2,471,707 door positioning mechanisms have been devised for holding a door open in various positions. But those previously devised were rather complicated and required pistons, valves, and fluid passages to operate. This made their manufacture difficult and expensive.

In this invention, the concealed door positioning device is particularly suited for double doors with arcuate tops. These types of double doors are usually found in expensive homes, suites in hotels, or corporate offices. Although it is a simple matter to design conventional door positioning devices, there is a demand for door positioning devices which can be concealed when used in luxurious homes or suites.

BRIEF SUMMARY

In this invention the door positioning device is mounted inside the door jamb. A generally U-shaped pivot bracket is screwed into the hinged edge of the door. A pivot pin extends through the legs of the bracket and through a universal connector which rotates on the pivot pin. The universal connector includes a pivotal yoke which pivots on a yoke pin comprising spaced legs in which a universal pivot block is positioned.

A bifurcated rocker arm is pivotally connected to the pivot block and to one end of a link. The rocker arm is secured to the mechanism by a pivot pin. The opposite end of the link is pivotally secured to a piston head which rides in a cylinder. A piston shaft is secured to the lower part of the piston head and through a shock absorbing device. The lower part of the piston shaft below the shock absorbing device is undercut flat so it can ride over a spring biased roller. The roller is mounted in the mechanism housing for reasons to be described below.

The undercut flat portion of the shaft below the shock absorbing device extends through and is secured to an adjustable block. This block is provided with a plurality of horizontally spaced roller receiving recesses which engage the above described roller. As the door is opened, the piston and shaft move upward until the roller engages one of the recesses on the stop block. This holds the door open at the position desired. If it is desirable to hold the door open at an alternate position, the door is swung open until the roller engages an adjacent roller receiving recess on the block.

When there is need to close the doors, a slight pressure on the door would be sufficient to disengage the roller from the roller receiving recess thus permitting the door to close. When the top of the door is curved or when there are double doors, the two panel doors define an archway. As a consequence, any visible door stop mechanism would be distracting to the elegant appearance of the entrance.

What is needed therefore is to provide a concealed door positioning mechanism which can be used with doors of any shape and eliminates the use of fluids, pistons, and valves.

These and other objects of this invention will become more apparent when better understood in the light of the accompanying drawings wherein.

Figure 1:
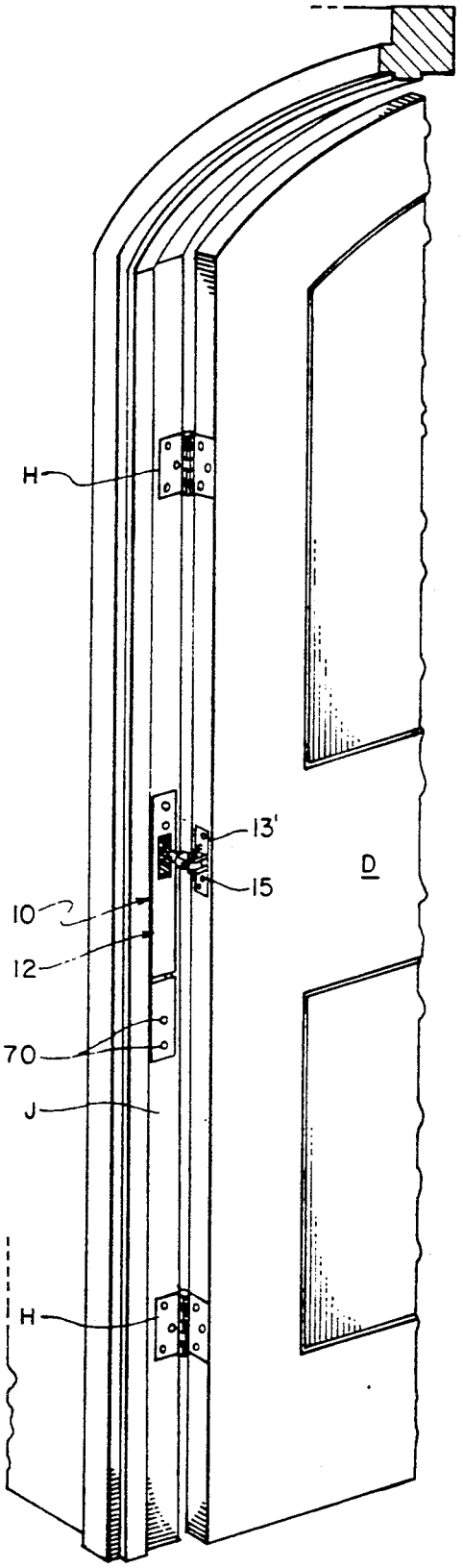
FIG. 1 is a perspective view of a portion of an arcuate shaped door and the adjoining door jamb in which the door mechanism is mounted.
Figure 2:
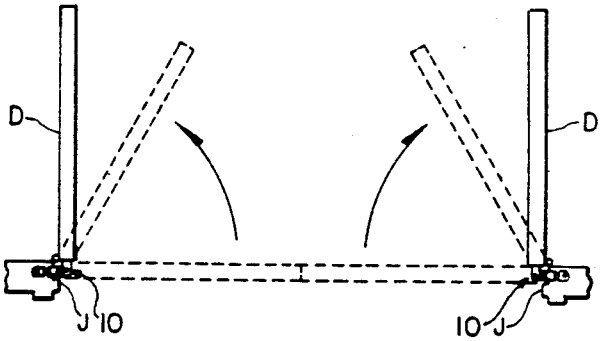
FIG. 2 is a top view of twin doors having the above described mechanism installed showing a wide open position, and a partially open position.
Figure 6:
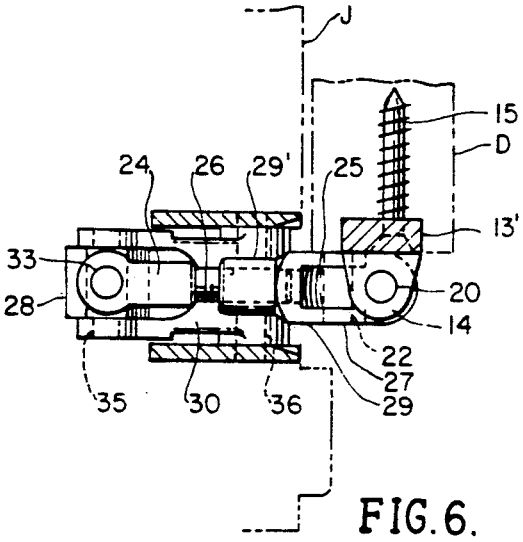
FIG. 6 is a cross sectional view taken on the line 6—6 of FIG. 3.

Referring now to FIG. 1 of the drawing, there is shown a partial perspective view of a door D containing a concealed door stop 10 installed within the door jamb J connected to said door jamb by hinges H.

Figure 3:
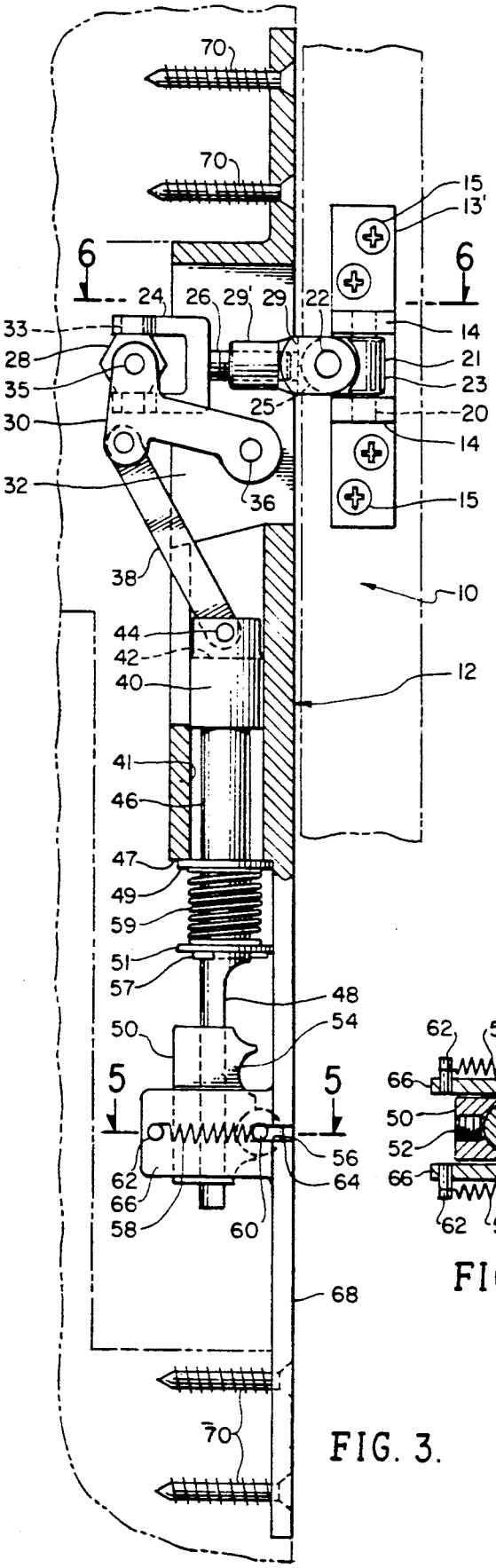
FIG. 3 is a longitudinal sectional view of the door mechanism with the door in an open position.
Figure 4:
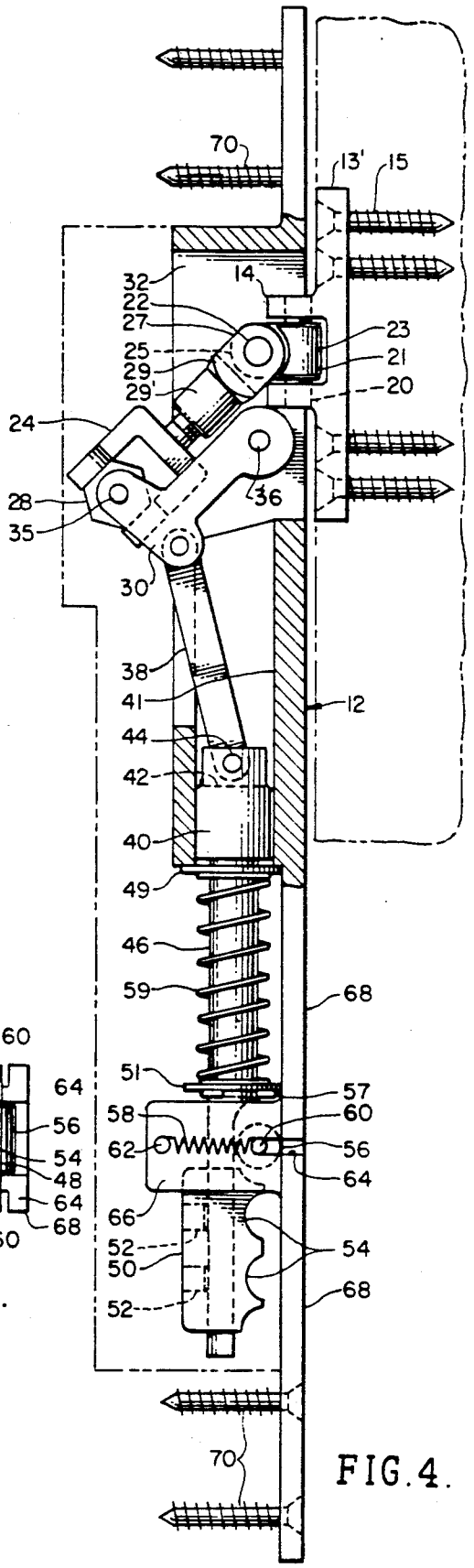
FIG. 4 is a longitudinal sectional view of the door mechanism with the door in a closed position.

A support bracket 13' is secured to the edge of the door by screws 15. Referring now to FIGS. 3 and 4, the bracket 13' has spaced outwardly projecting arms 14 through which a pivot pin 20 is inserted. The pivot pin 20 extends through a yoke engaging universal member 21. The yoke engaging member 21 has a rounded pivotal portion 23 for clearance to allow the door to swing open. In addition, the yoke engaging member 21 has a protruding portion 25 sized to fit between the arms 27 of a first yoke 29, see FIGS. 4 and 7. A yoke pin 22 extends through a correspondingly sized hole 25' in the protruding portion 25 and holes 31 in the arms 27 of the first yoke, see FIG. 3 so that the first yoke 29 is attached to the protruding portion 25 and can rotate with said rounded portion 23 on pivot pins 20, and can also rotate on yoke pins 22 which extend through holes 31 in arms 27 and through the hole 25' extending through the protruding portion 25, see FIG. In this way, the yoke 29 can rotate in a plane perpendicular to the plane of the face of the door, and can pivot on pivot pins 20 as shown in FIG. 4.

Figure 7:
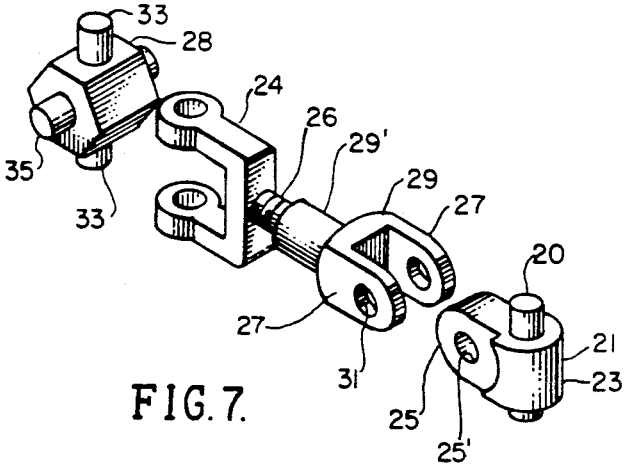
FIG. 7 is a partial exploded perspective view of the parts disclosing the double universal joints.

The first yoke 29 is integrally formed with a generally cylindrical protruding member 29' having a threaded bore for receiving a threaded shaft 26 for length adjustment. In this way the mechanism for holding the door open can be used with doors of different sizes. The threaded shaft 26 is an integral extension of a second yoke 24 in which a universal pivot block 28 is positioned. As shown in FIG. 7, the pivot block 28 has pins 33 which extend through parallel arms in yoke 24 to hold the universal pivot block 28 so it can pivot in a horizontal plane. The pivot block 28 has an additional pin 35 connected to one end of a pivotal bifurcated rocker arm 30. The other extension of the bifurcated rocker arm 30 is pivotally connected to one end of a link 38. In addition, the bifurcated rocker arm is pivotally mounted within the hollow cavity of the mechanism housing 32 by a pin 36, see FIG. 3.

The opposite end of the link 38 is pivotally mounted within a slot 42 at the top end of a piston 40 by a piston pin 44 see FIG 3. The piston is guided by and rides within a cylinder 41 inside the mechanism housing 32.

A piston shaft 46, depends from the bottom of the piston 40. The circumferential portion 47 of the lower end of the cylinder 41 is flat to serve as a stop for an upper washer 49. A lower washer 51 is secured to the shaft 46 by a cotter pin 57 which holds the lower washer to the shaft. A shock absorbing coil spring 59 is positioned between the upper washer 49 and the lower washer 51. As shown in FIG. 3, when the door 10 is opened the shock absorbing coil spring 59 is compressed between the upper washer 49 and the lower washer 51 thus producing a gentler engagement of the roller 56 and its recess 54. This eliminates damage to the mechanism.

In addition if the door is by some resilient means held in an open or partially open position, the spring 59 is under compression. If adequate force is then exerted on the door in a closing direction, this force overcomes the resilient means holding the door in an open or partially open position, thereby releasing the compression on the spring 59 and allowing it to expand and close the door.

Figure 5:
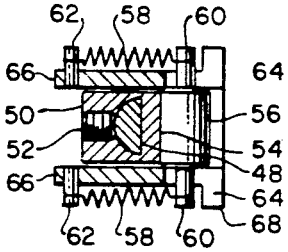
FIG. 5 is a cross sectional view taken on the line 5—5 of FIG. 3.

The lower portion of the piston shaft 46 is undercut below washer 51 at 48 to form a flat surface. The piston shaft extends through and is secured to a block 50. The block is secured to the flat roller receiving surface 48 by a pair of set screws 52 see FIGS. 4 and 5. The block 50 is provided with one or more arcuate roller receiving recesses 54 facing the outer surface of the door jamb, thus enabling the door or a pair of doors to be held open at selected angles as will be described below.

The block mechanism comprises inwardly extending walls 66, a pair of pins 62 is positioned on the inner ends of said walls and a roller 56 with its shaft 60 is positioned in two retainer slots 64 in the channel walls 66. The ends of the roller shaft 60 extend through the roller 56 and beyond the channel walls 66. A pair of tension springs 58 are connected between the pins 62 and the ends of roller shaft 60 for biasing the roller 56 into one of the roller receiving recesses 54 formed in the stop block 50. The retainer slots 64 extend to the surface of the base plate 68 so that in the event a tension spring breaks, the roller can be easily removed and the retainer spring replaced without removing the complete door stop mechanism 10.

The jamb mechanism 12 is covered by the base plate 68 which is removably attached to the jamb by a plurality of screws 70 thus concealing the inner mechanism.

In operation, the position of the linkage in the door jamb mechanism when the door is open is shown in FIG. 3. As the door is opened, the first and second universal members 21 and 28 cause the yoke 24 to pivot in a direction causes the piston 40 and the shaft 46 along with block 50 to move upward. The roller receiving recesses 54 formed in the block 50 enable the tension springs 58 to pull the roller 56 into one or the other recesses thus holding the door or doors open at desired angle. The block 50 is provided with retainer slots 54, shown in FIG. 5, thus permitting the roller 56 to move in an out of the arcuate recesses 54.

When the stop block 50 is provided with more than one recess 54, the doors can be held open at various angles, when it is desirable to control the rate of flow of people or air through the double doors. As shown in FIG. 1, the top of the door is curved and a pair of such doors would form an arch giving the entrance an elegant appearance.

Having described the invention, what I claim is:

1. In a concealed door positioning device for holding a door open in a selected position comprising a door jamb, a housing concealed in said door jamb, a mechanism in said housing, said mechanism comprising a cylinder mounted in the housing, a slidable piston in said cylinder, said piston having a top portion and a lower portion, linkage in said door jamb and said door connected together, the linkage in said door jamb connected to the top portion of said piston in such a way that when the door is opened, the linkage in said door jamb forces said piston upward in said cylinder, a shaft integral with and depending from the piston lower portion, resiliently mounted means in said housing for engaging said shaft when said piston moves a predetermined distance up said cylinder for holding said shaft in a fixed position whereby said door is held open at a desired angle, the force of said resilient means holding said shaft and said piston in a fixed position selected so when a slight pressure is exerted on the door in a closing direction, the force holding the said door open is overcome, and the door can close.

2. The concealed door positioning device described in claim 1 including a cover on said door jamb for concealing said mechanism in said housing.

3. The concealed door positioning device described in claim 2 including a block mounted on said shaft, said shaft extending through said block wherein said resiliently mounted means comprises, a block engaging movable element in said door jamb, means biasing said block engaging movable element toward said block for engagement therewith, said block having a surface facing said movable element and shaped so when it is engaged by said movable element, the movable element adheres to said surface of said block to hold the shaft and piston in a fixed position with said door open at desired angle, until force exerted against said door in a closing direction is sufficient to overcome the force exerted by said biasing means holding said movable element in engagement with said block, thereby allowing the door to close.

4. The concealed door positioning device described in claim 3 wherein said movable element comprises a roller mounted on said housing and biased toward said surface on said block, said surface having at least one recess deep enough so as the shaft moves downward said biasing means moves said roller into said recess whereby said shaft and said roller are held in a fixed position with the door held open at a desired angle.

5. The concealed door positioning device described in claim 4, including a shock absorbing device mounted inside the door jamb above said block so that if wind or some other force slams said block against the shock absorbing device, the shock absorbing device prevents the block from striking the lower end of said cylinder and causing damage to the mechanism.

6. The concealed door positioning device described in claim 1 wherein said linkage comprises a first universal swivel joint, secured to said door, a second universal swivel joint connected to said first universal swivel joint and extending inside said housing, and linkage connecting said second universal swivel joint to the top portion of said piston, said universal swivel joints connected together in such a way that when the door is opened, the universal swivel joints move in a direction which causes said linkage to force said piston and said shaft up said cylinder whereby said resiliently mounted means engages said shaft to hold said door open in a desired position.

7. The concealed door positioning device described in claim 6 wherein said first and second universal swivel joints have adjustment means so that the concealed door positioning device can be used with different thickness of doors.

* * * * *